US006150954A

United States Patent [19]

Smith

[11] Patent Number: 6,150,954

[45] Date of Patent: Nov. 21, 2000

[54] SUBSEA TEMPLATE ELECTROMAGNETIC TELEMETRY

[75] Inventor: Harrison C. Smith, Anna, Tex.

[73] Assignee: Halliburton Energy Services, Inc., Dallas, Tex.

[21] Appl. No.: 09/032,486

[22] Filed: Feb. 27, 1998

[51] Int. Cl.[7] ..... G01V 1/00

[52] U.S. Cl. ..... 340/854.6; 340/853.3

[58] Field of Search ..... 340/853.3, 853.1, 340/853.5, 853.7, 854.6, 854.9, 855.2, 854.8, 854.4, 855.4; 166/65.1, 313, 50, 64

[56] References Cited

U.S. PATENT DOCUMENTS

| | | | |
|---|---|---|---|
| 4,793,418 | 12/1988 | Wheeler et al. | 166/357 |
| 4,901,069 | 2/1990 | Veneruso | 340/854.8 |
| 5,008,664 | 4/1991 | More et al. | 340/854.8 |
| 5,278,550 | 1/1994 | Knudsen et al. | 340/855.1 |
| 5,363,095 | 11/1994 | Normann et al. | 340/854.7 |
| 5,721,538 | 2/1998 | Tubel et al. | 340/853.4 |
| 5,941,307 | 8/1999 | Tubel | 166/313 |
| 5,942,990 | 8/1999 | Smith et al. | 340/853.7 |
| 5,959,548 | 9/1999 | Smith | 340/854.8 |

*Primary Examiner*—Douglas W. Olms
*Assistant Examiner*—Brian Nguyen
*Attorney, Agent, or Firm*—William M. Imwalle; Lawrence R. Youst

[57] ABSTRACT

An electromagnetic downlink and pickup apparatus for transmitting and receiving electromagnetic signals is disclosed. The electromagnetic downlink and pickup apparatus includes a subsea conductor (47) disposed beneath the sea floor (16) and a surface installation (58) for generating and interpreting signals. The subsea conductor (47) and the surface installation (58) are electrically connecting by first and second conduits (30, 51) that form a pair terminals on the subsea conductor (47) between which a voltage potential may be established, thereby providing a path for current flow therebetween.

49 Claims, 7 Drawing Sheets

10
12
14
15
16
18
20
22
24
26
28
30
32
34
36
37
38
40
41
42
43
44
45
46
47
48
49
50
51
52
53
54
55
56
57
58
59
60
61
62
63
64
65
66
67
68
70
72
74
76
78
80
82
84
86

SUBSEA TEMPLATE ELECTROMAGNETIC TELEMETRY

TECHNICAL FIELD OF THE INVENTION

This invention relates in general to downhole telemetry and, in particular to, utilizing the subsea template of a platform to carry an electrical current for communicating electromagnetic signals carrying information between surface equipment and downhole equipment.

BACKGROUND OF THE INVENTION

Without limiting the scope of the invention, its background is described in connection with communication between surface equipment and downhole devices during hydrocarbon production, as an example. It should be noted that the principles of the present invention are applicable not only during production, but throughout the life of a wellbore including, but not limited to, during drilling, logging, testing and completing the wellbore.

Heretofore, in this field, a variety of communication and transmission techniques have been attempted to provide real time communication between surface equipment and downhole devices. The utilization of real time data transmission provides substantial benefits during the production of hydrocarbons from a field. For example, monitoring of downhole conditions allows for an immediate response to potential well problems including production of water or sand.

One technique used to telemeter downhole data to the surface uses the generation and propagation of electromagnetic waves. These waves are produced by inducing an axial current into, for example, the production casing. This current produces the electromagnetic waves that include an electric field and a magnetic field, which are formed at right angles to each other. The axial current impressed on the casing is modulated with data causing the electric and magnetic fields to expand and collapse thereby allowing the data to propagate and be intercepted by a receiving system. The receiving system is typically connected to the ground or sea floor where the electromagnetic data is picked up and recorded.

As with any communication system, the intensity of the electromagnetic waves is directly related to the distance of transmission. As a result, the greater the distance of transmission, the greater the loss of power and hence the weaker the received signal at the surface. Additionally, downhole electromagnetic telemetry systems must transmit the electromagnetic waves through the earth's strata. In free air, the loss is fairly constant and predictable. When transmitting through the earth's strata, however, the amount of signal received is dependent upon the skin depth ($\delta$) of the media through which the electromagnetic waves travel. Skin depth is defined as the distance at which the power from a downhole signal will attenuate by a factor of 8.69 db (approximately 7 times decrease from the initial power input), and is primarily dependent upon the frequency (f) of the transmission and the conductivity ($\sigma$) of the media through which the electromagnetic waves are propagating. For example, at a frequency of 10 hz, and a conductance of 1 mho/meter (1 ohm-meter), the skin depth would be 159 meters (522 feet). Therefore, for each 522 feet in a consistent 1 mho/meter media, an 8.69 db loss occurs. Skin depth may be calculated using the following equation.

Skin Depth$=\delta=1/\sqrt{(\pi f \mu \sigma)}$ where:

$\pi=3.1417$;

f=frequency (hz);

$\mu$=permeability ($4\pi\times10^{6}$); and $\sigma$=conductance (mhos/meter).

As should be apparent, the higher the conductance of the transmission media, the lower the frequency must be to achieve the same transmission distance. Likewise, the lower the frequency, the greater the distance of transmission with the same amount of power.

A typical electromagnetic telemetry system that transmits vertically through the earth's strata may successfully propagate through ten (10) skin depths. In the example above, for a skin depth of 522 feet, the total transmission and successful reception depth would only be 5,220 feet. It has been found, however, that in offshore applications, the boundary between the sea and the sea floor has a nonuniform and unexpected electrical discontinuity. Conventional electromagnetic systems are, therefore, unable to effectively transmit or receive the electromagnetic signals through the boundary between the sea and the sea floor. Additionally, it has been found that conventional electromagnetic systems are unable to effectively transmit the electromagnetic signals through sea water or through the boundary layer between the sea and air.

Therefore, a need has arisen for a system that is capable of telemetering real time data between the surface and downhole devices using electromagnetic waves to carry the information. A need has also arisen for an electromagnetic telemetry system that is capable of transmitting and receiving electromagnetic signals below the sea floor and relaying the information carried in the electromagnetic signals through the sea water to the surface. Further, a need has arisen for such an electromagnetic telemetry system that is capable communicating commands to specific downhole devices and receiving confirmation that the operation requested in the command has occurred.

SUMMARY OF THE INVENTION

The present invention disclosed herein comprises a subsea template electromagnetic telemetry system that is capable of telemetering real time data between the surface and downhole devices using electromagnetic waves to carry the information. The system transmits and receives electromagnetic signals below the sea floor and relays the information carried in the electromagnetic signals through the sea water to the surface. The system provides a method to communicate commands to specific downhole devices and receiving confirmation that the operation requested in the command has occurred.

The subsea template electromagnetic telemetry system comprises an electromagnetic downlink and pickup apparatus that includes a subsea conductor and a surface installation. The subsea conductor may be, for example, a subsea template of an offshore production platform. The subsea conductor and the surface installation are electrically connected using a pair of conduits. The conduits form a pair terminals on the subsea conductor between which a voltage potential may be established, thereby providing a path for current flow therebetween.

The surface installation includes a signal generator and a signal receiver. The signal generator injects a current carrying information into the subsea conductor that will generate electromagnetic waves carrying the information which are propagated downhole through the earth. The signal receiver interprets information carried in a current generated in the subsea conductor by electromagnetic waves received by the subsea conductor.

The conduits electrically connecting the subsea conductor to the surface installation may be electrical wires. Alternatively, one or both of the conduits electrically connecting the subsea conductor to the surface installation may be riser pipes including platform legs, conductor pipes of wells and the like.

The subsea conductor may have an electrical coupling extending outwardly therefrom and extending above the sea floor to provide a connection between an electric wire and the subsea conductor. The electrical coupling may be a post, a ring or the like.

The electromagnetic downlink and pickup apparatus may be used with the telemetry system for changing the operational state of a downhole device. In this case, the surface installation transmits a command signal to the subsea conductor. The subsea conductor retransmits the command signal using electromagnetic waves. The electromagnetic waves are received by an electromagnetic receiver disposed in a wellbore. An electronics package electrically connected to the electromagnetic receiver and operably connected to the downhole device, generates a driver signal in response to the command signal that prompts the downhole device to change operational states.

The downhole portion of the system may include an electromagnetic transmitter disposed in the wellbore. The electromagnetic transmitter may transmit a verification signal to indicate that the command signal has been received and that the command has been executed or both. The verification signal is received by the subsea conductor that forwards the signal to the surface installation.

The system is capable of operating numerous downhole devices disposed in multiple wells extending from one or more platforms. To achieve this result, the command signal generated by the surface installation are uniquely associated with specific downhole devices.

BRIEF DESCRIPTION OF THE DRAWINGS

For a more complete understanding of the present invention, including its features and advantages, reference is now made to the detailed description of the invention, taken in conjunction with the accompanying drawings of which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the invention.

Figure 1:
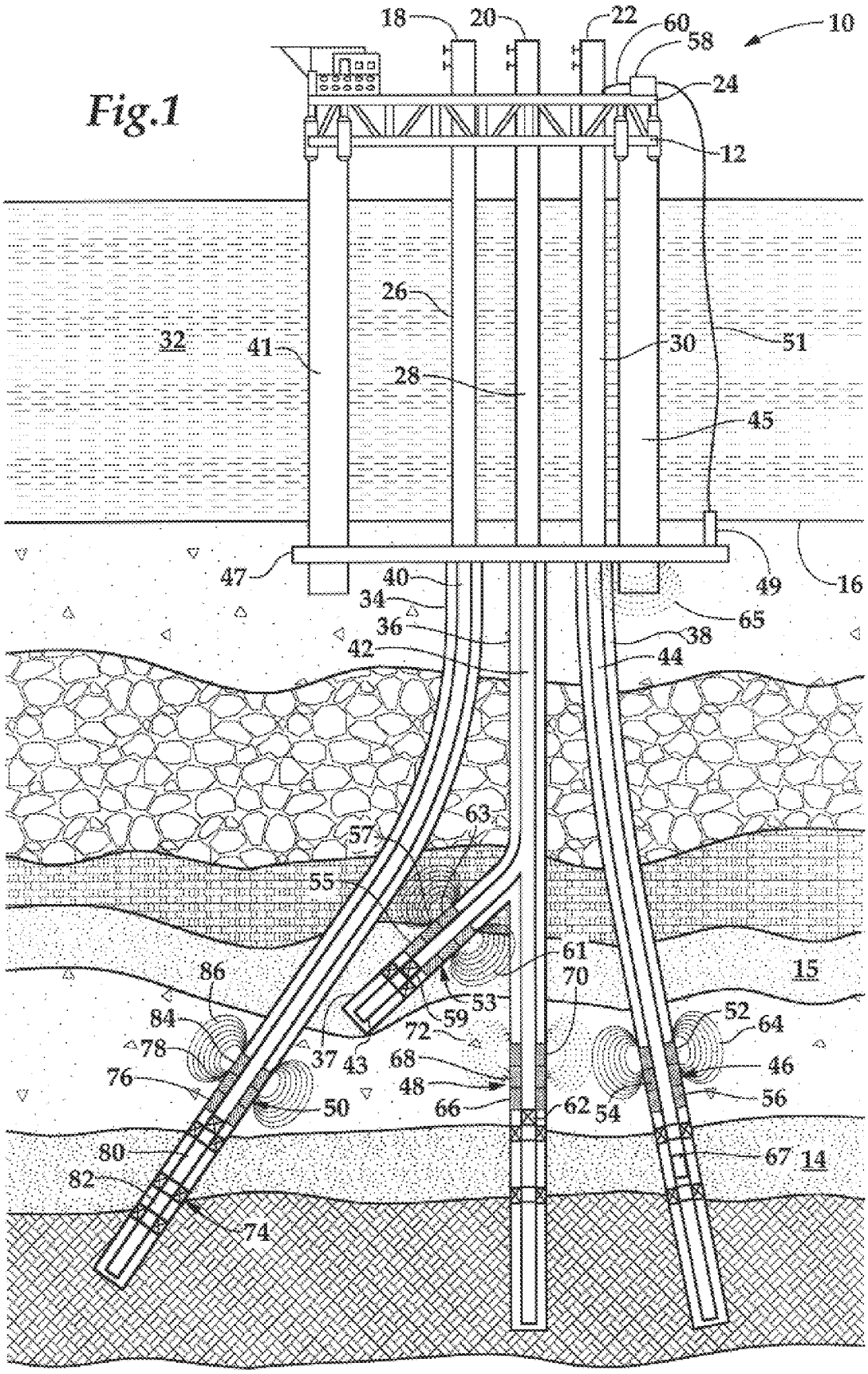
FIG. 1 is a schematic illustration of an offshore oil and gas production platform operating a subsea template electromagnetic telemetry system of the present invention.

Referring to FIG. 1, a subsea template electromagnetic telemetry system in use on an offshore oil and gas platform is schematically illustrated and generally designated 10. A production platform 12 is centered over submerged oil and gas formations 14, 15 located below sea floor 16. Wellheads 18, 20, 22 are located on deck 24 of platform 12. Wells 26, 28, 30 extend through the sea 32 and penetrate the various earth strata including formations 14, 15, forming, respectively, wellbores 34, 36, 38, each of which may be cased or uncased. Wellbore 36 includes a lateral or branch wellbore 37 that extends from the primary wellbore 36. The lateral wellbore 37 is completed in formation 15 which may be isolated for selective production independent of production from formation 14 into wellbore 36. Also extending from wellheads 18, 20, 22 are tubing 40, 42, 44 which are respectively, disposed in wellbores 34, 36, 38. Tubing 43 is disposed in lateral wellbore 37 and may join tubing 42 for production thererhrough.

Wells 26, 28, 30 along with legs 41, 45 extend through subsea template 47. Subsea template 47 helps to support platform 12 and allows for the accurate positioning of wells 26, 28, 30. Extending outwardly from subsea template 47 is coupling 49 which may be a ring, a post or the like. Coupling 49 is electrically connected to electrical wire 51 that extends through sea 32 and terminates at surface installation 58. An electrical wire 60 connects surface installation 58 to the conductor pipe of well 30. Thus, a complete electric circuit is formed that includes subsea template 47, coupling 49, electrical wire 51, surface installation 58, electrical wire 60 and the conductor pipe of well 30.

Surface installation 58 may be composed of a computer system that processes, stores and displays information relating to formations 14, 15 such as production parameters including temperature, pressure, flow rates and oil/water ratio. Surface installation 58 also maintains information relating to the operational states of the various downhole devices located in wellbores 34, 36, 37, 38. Surface installation 58 may include a peripheral computer or a work station with a processor, memory, and audio visual capabilities. Surface installation 58 includes a power source for producing the necessary energy to operate surface installation 58 as well as the power necessary to generate a current between electrical coupling 49 and well 30 through subsea template 47. This current will, in turn, generate electromagnetic wave fronts 65. As such, surface installation 58 is used to generate command signals that will operate various downhole devices. Electrical wires 51, 60 may be connected to surface installation 58 using an RS-232 interface.

As part of the final bottom hole assembly prior to production, a sonde 46 is disposed within wellbore 38.

Likewise, sondes 48, 50, 53 are respectively disposed within wellbores 36, 34, 37. Sonde 46 includes an electromagnetic transmitter 52, an electronics package 54 and an electromagnetic receiver 56. Also disposed in wellbore 38 are sensors 67 which may obtain, for example, temperature, pressure, flowrate, or fluid composition data relating to production from formation 14. Thus, if the operator needs to obtain real time information from formation 14, surface installation 58 would generate a request for information by injecting a modulated current through subsea template 47 between coupling 49 and well 30. The current will produce the modulated electric and magnetic fields of electromagnetic wave fronts 65 to communicate the request to sonde 46. Electromagnetic wave fronts 65 are picked up by electromagnetic receiver 56 of sonde 46 and passed on to electronics package 54 for processing and amplification. Electronics package 54 interfaces with sensors 67 requesting the desired information.

Once sensors 67 obtain the information, the information is returned to electronics packages 54 for processing. Electronics package 54 then establishes the frequency, power and phase output of the information prior to forwarding the information to electromagnetic transmitter 52 of sonde 46 that radiates electromagnetic wave fronts 64 into the earth. The electric field of electromagnetic wave fronts 64 will generate a modulated current in subsea template 47 between coupling 49 and well 30 which serve as electrodes for sensing the voltage therebetween. The information then travels to surface installation 58 via electrical wave 51. The information may then be processed by surface installation 58 and placed in a useable format.

AlternativeLy, if the operator wanted to reduce the flow rate of production fluids in well 28, surface installation 58 would be used to generate a command signal to restrict the opening of bottom hole choke 62. The command signal would be injected into subsea template 47 via electrical wire 51. The command signal would then be radiated into the earth in the form of electromagnetic wave fronts 65. Electromagnetic wave fronts 54 are picked up by electromagnetic receiver 66 of sonde 48. The command signal is then forwarded to electronics package 68 of sonde 48 for processing and amplification. Electronics package 68 interfaces with bottom hole choke 62 and sends a driver signal to bottom hole choke 62 to restrict the flow rate therethrough.

Once the flow rate in well 28 has been restricted by bottom hole choke 62, bottom hole choke 62 interfaces with electronics package 68 of sonde 48 to provide verification that the command generated by surface installation 58 has been accomplished. Electronics package 68 then sends the verification signal to electromagnetic transmitter 70 of sonde 48 that radiates electromagnetic wave fronts 72 into the earth which are picked up by subsea template 47 and passed onto surface installation 58 via electrical wire 51 as describe above.

As another example, the operator may want to shut in production in lateral wellbore 37. As such, surface installation 58 would generate the shut in command signal and inject it into subsea template 47. Electromagnetic wave fronts 65 are then generated as described above. The shut in command would be packed up by electromagnetic receiver 55 of sonde 53 and processed in electronics package 57 of sonde 53. Electronics package 57 interfaces with valve 59 causing valve 59 to close. This change in the operational state of valve 59 would be verified to surface installation 58 as described above, by radiating electromagnetic wave fronts 61 from electromagnetic transmitter 63 which generate a current in subsea template 47 that relays the verification to surface installation 58 via electrical wire 51.

Similarly, the operator may want to actuate a sliding sleeve in a selective completion with sliding sleeves 74. A command signal would again be generated by surface installation 58 and injected into subsea template 47 via electrical wire 51. Electromagnetic wave fronts 65 would then be generated, thereby transmitting the command signal to electromagnetic receiver 76 of sonde 50. The command signal is forwarded to electronics package 78 for processing, amplification and generation of a driver signal. Electronics package 78 then interfaces with sliding sleeves 80, 82 and sends the driver signal to shut off production from the lower portion of formation 14 by closing sliding sleeve 82 and allow production from the upper portion of formation 14 by opening sliding sleeve 80. Sliding sleeves 80, 82 interface with electronics package 78 of sonde 50 to provide verification information regarding their respective changes in operational states. This information is processed and passed to electromagnetic transmitter 84 which generates electromagnetic wave fronts 86. Electromagnetic wave fronts 86 propagated through the earth and are picked up by subsea template 47. The verification information is then passed onto surface installation 58 via electrical wire 51 for analysis and storage.

Each of the command signals generated by surface installation 58 is uniquely associated with a particular downhole device such as bottom hole choke 62, valve 59, sensors 67 or sliding sleeves 80, 82. Thus, as will be further discussed with reference to FIGS. 9 and 10 below, electronics package 68 of sonde 46 will only process a command signal that is uniquely associated with a downhole device, such as bottom hole choke 62, located within wellbore 36. Similarly, electronics package 57 of sonde 46 will only process a command signal that is uniquely associated with a downhole device, such as valve 59, located within wellbore 37, while electronics package 54 of sonde 46 will only process a command signal that is uniquely associated with a downhole device, such as sensors 67, located within wellbore 38 and electronics package 78 of sonde 50 will only process a command signal uniquely associated with a downhole device, such as sliding sleeves 80, 82, located within wellbore 34. Thus, the subsea template electromagnetic telemetry system of the present invention allows for the monitoring of well data and the control of multiple downhole devices located in multiple wells from one central point.

Even though FIG. 1 depicts three wells 26, 28, 30 extending from a single platform 12, it should be apparent to those skilled in the art that the principles of the present invention are applicable to a single platform having any number of wells or to multiple platforms so long as the wells are within the transmission range of the electromagnetic wave such as electromagnetic wave fronts 65 from the master platform such as platform 12. It should be noted, that the transmission range of electromagnetic waves such as electromagnetic wave fronts 65 is significantly greater when transmitting horizontally through a single or limited number of strata as compared with transmitting vertically through numerous strata. For example, electromagnetic waves such as electromagnetic wave fronts 65 may travel between 3,000 and 6,000 feet vertically while traveling between 15,000 and 30,000 feet horizontally depending on factors such as the voltage, the frequency of transmission, the conductance of the transmission media, and the level of noise. The transmission range of electromagnetic waves such as electromagnetic wave fronts 65 may be extended, however, using electromagnetic repeaters that may extend either the vertical or horizontal transmission range or both.

Even though FIG. 1 depicts well 30 as completing the electrical circuit between surface installations 58 and subsea template 47, it should be understood by those skilled in the art that a variety of electrical connections could be used to complete the electrical circuit including, but not limited to, wells 26, 28, legs 41, 45 or other riser pipe in electrical contact with subsea template 47. Also, it should be understood by those skilled in the art that the current injected by surface installation 58 may travel either from well 30 to coupling 49 or from coupling 49 to well 30 for the generation of electromagnetic wave fronts 65. Similarly, it should be understood by those skilled in the art that the current generated between well 30 and coupling 49 by electromagnetic waves such as electromagnetic wave fronts 61, 64, 72, 86 may travel either from well 30 to coupling 49 and up electrical wire 51 to surface installation 58 or from coupling 49 to well 30 and up the conductor pipe of well 30 to surface installation 58.

Figure 2A:
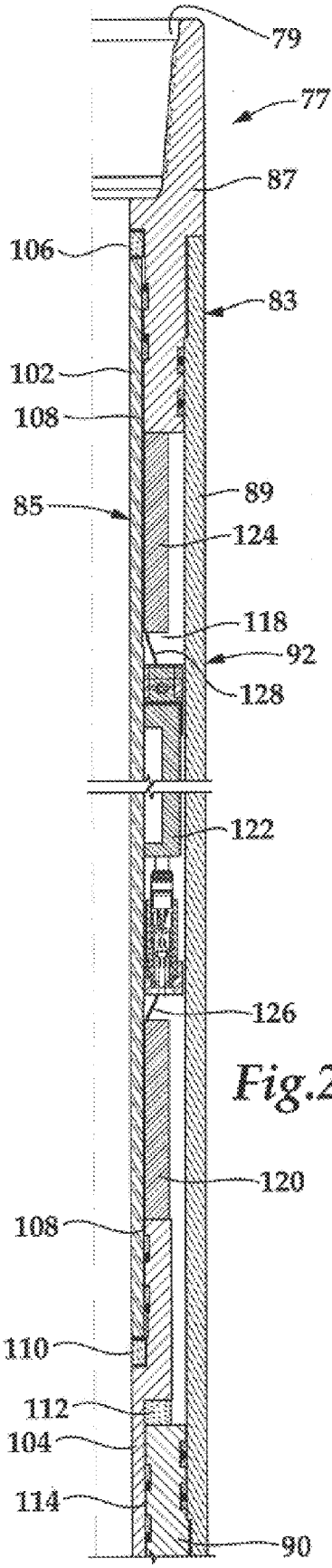
FIGS. 2A–2B are quarter-sectional views of a sonde of a subsea template electromagnetic telemetry system of the present invention.
Figure 2B:
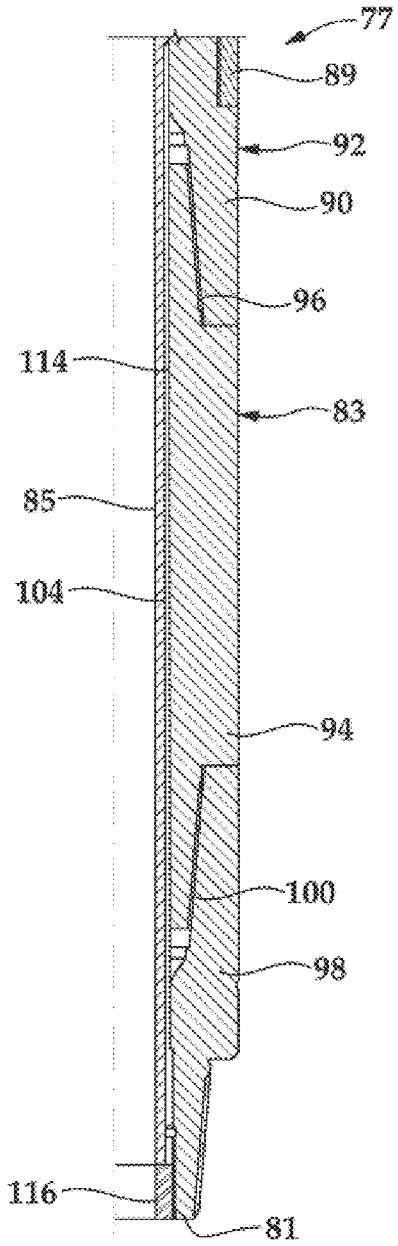

Representatively illustrated in FIGS. 2A–2B is a sonde 77 of the present invention. For convenience of illustration, FIGS. 2A–2B depict sonde 77 in a quarter sectional view. Sonde 77 has a box end 79 and a pin end 81 such that sonde 77 is threadably adaptable to other tools in a final bottom hole assembly. Sonde 77 has an outer housing 83 and a mandrel 85 having a full bore so that when sonde 77 is disposed within a well, tubing may be inserted therethrough. Housing 83 and mandrel 85 protect the operable components of sonde 77 during installation and production.

Housing 83 of sonde 77 includes an axially extending and generally tubular upper connecter 87. An axially extending generally tubular intermediate housing member 89 is threadably and sealably connected to upper connecter 87. An axially extending generally tubular lower housing member 90 is threadably and sealably connected to intermediate housing member 89. Collectively, upper connecter 87, intermediate housing member 89 and lower housing member 90 form upper subassembly 92. Upper subassembly 92 is electrically connected to the section of the casing above sonde 77.

An axially extending generally tubular isolation subassembly 94 is securably and sealably coupled to lower housing member 90. Disposed between isolation subassembly 94 and lower housing member 90 is a dielectric layer 96 that provides electric isolation between lower housing member 90 and isolation subassembly 94. Dielectric layer 96 is composed of a dielectric material, such as teflon, chosen for its dielectric properties and capably of withstanding compression loads without extruding.

An axially extending generally tubular lower connecter 98 is securably and sealably coupled to isolation subassembly 94. Disposed between lower connecter 98 and isolation subassembly 94 is a dielectric layer 100 that electrically isolates lower connecter 98 from isolation subassembly 94. Lower connecter 98 is electrically connected to the portion of the casing below sonde 77.

It should be apparent to those skilled in the art that the use of directional terms such as above, below, upper, lower, upward, downward, etc. are used in relation to the illustrative embodiments as they are depicted in the figures, the upward direction being toward the top of the corresponding figure and the downward direction being toward the bottom of the corresponding figure. It is to be understood that the downhole component described herein, for example, sonde 77, may be operated in vertical, horizontal, inverted or inclined orientations without deviating from the principles of the present invention.

Mandrel 85 includes axially extending generally tubular upper mandrel section 102 and axially extending generally tubular lower mandrel section 104. Upper mandrel section 102 is partially disposed and sealing configured within upper connecter 87. A dielectric member 106 electrically isolates upper mandrel section 102 from upper connecter 87. The outer surface of upper mandrel section 102 has a dielectric layer disposed thereon. Dielectric layer 108 may be, for example, a teflon layer. Together, dielectric layer 108 and dielectric member 106 serve to electrically isolate upper connecter 87 from upper mandrel section 102.

Between upper mandrel section 102 and lower mandrel section 104 is a dielectric member 110 that, along with dielectric layer 108, serves to electrically isolate upper mandrel section 102 from lower mandrel section 104. Between lower mandrel section 104 and lower housing member 90 is a dielectric member 112. On the outer surface of lower mandrel section 104 is a dielectric layer 114 which, along with dielectric member 112, provides for electric isolation of lower mandrel section 104 from lower housing number 90. Dielectric layer 114 also provides for electric isolation between lower mandrel section 104 and isolation subassembly 94 as well as between lower mandrel section 104 and lower connecter 98. Lower end 116 of lower mandrel section 104 is disposed within lower connecter 98 and is in electrical communication with lower connecter 98. Intermediate housing member 89 of outer housing 83 and upper mandrel section 102 of mandrel 85 define annular area 118. A receiver 120, an electronics package 122 and a transmitter 124 are disposed within annular area 118.

In operation, sonde 77 receives a command signal in the form of electromagnetic wave fronts 65 generated by subsea template 47 of FIG. 1. Electromagnetic receiver 120 forwards the command signal to electronics package 122 via electrical conductor 126. Electronics package 122 processes the command signal as will be discussed with reference to FIGS. 9 and 10 and generates a driver signal. The driver signal is forwarded to the downhole device uniquely associated with the command signal to change the operational state of the downhole device. A verification signal is returned to electronics package 122 from the downhole device and is processed and forwarded to electromagnetic transmitter 124. Electromagnetic transmitter 124 transforms the verification signal into electromagnetic waves which are radiated into the earth and picked up by subsea template 47 and passed to surface installation 58 via electrical wire 51.

Figure 3:
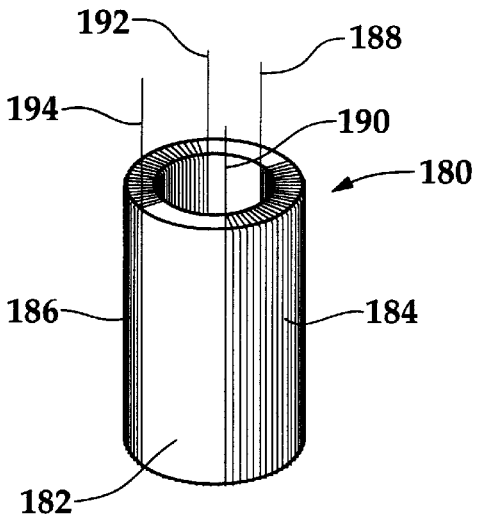
FIG. 3 is a schematic illustration of a toroid having primary and secondary windings wrapped therearound for a sonde of a subsea template electromagnetic telemetry system of the present invention.

Referring now to FIG. 3, a schematic illustration of a toroid is depicted and generally designated 180. Toroid 180 includes magnetically permeable annular core 182, a plurality of electrical conductor windings 184 and a plurality of electrical conductor windings 186. Windings 184 and windings 186 are each wrapped around annular core 182. Collectively, annular core 182, windings 184 and windings 186 serve to approximate an electrical transformer wherein either windings 184 or windings 186 may serve as the primary or the secondary or the transformer.

In one embodiment, the ratio of primary windings to secondary windings is 2:1. For example, the primary windings may include 100 turns around annular core 182 while the secondary windings may include 50 turns around annular core 182. In another embodiment, the ratio of secondary windings to primary windings is 4:1. For example, primary windings may include 10 turns around annular core 182 while secondary windings may include 40 turns around annular core 182. It will be apparent to those skilled in the art that the ratio of primary windings to secondary windings as well as the specific number of turns around annular core 182 will vary based upon factors such as the diameter and height of annular core 182, the desired voltage, current and frequency characteristics associated with the primary windings and secondary windings and the desired magnetic flux density generated by the primary windings and secondary windings.

Toroid 180 of the present invention may serve, for example, as electromagnetic receiver 120 or electromagnetic transmitter 124 of FIG. 2. The following description of the orientation of windings 184 and windings 186 will therefore be applicable to each of the above.

With reference to FIGS. 2 and 3, windings 184 have a first end 188 and a second end 190. First end 188 of windings 184 is electrically connected to electronics package 122. When toroid 180 serves as electromagnetic receiver 120, windings 184 serve as the secondary wherein first end 188 of windings 184 feeds electronics package 122 with the command signal via electrical conductor 126. The command signal is processed by electronics package 122 as will be further described with reference to FIGS. 9, 10 below. When toroid 180 serves as electromagnetic transmitter 124, windings 184 serve as the primary wherein first end 188 of windings 184, receives the verification signal from electronics package 122 via electrical conductor 128. Second end 190 of windings 184 is electrically connected to upper subassembly 92 of outer housing 83 which serves as a ground.

Windings 186 of toroid 180 have a first end 192 and a second end 194. First end 192 of windings 186 is electrically connected to upper subassembly 92 of outer housing 83. Second end 194 of windings 186 is electrically connected to lower connecter 98 of outer housing 83. First end 192 of windings 186 is thereby separated from second end 192 of windings 186 by isolations subassembly 94 which prevents a short between first end 192 and second end 194 of windings 186.

When toroid 180 serves as electromagnetic receiver 120, electromagnetic wave fronts, such as electromagnetic wave fronts 65 induce a current in windings 186, which serve as the primary. The current induced in windings 186 induces a current in windings 184, the secondary, which feeds electronics package 122 as described above. When toroid 180 serves as electromagnetic transmitter 124, the current supplied from electronics package 122 feeds windings 184, the primary, such that a current is induced in windings 186, the secondary. The current in windings 186 induces an axial current on the casing, thereby producing electromagnetic waves.

Due to the ratio of primary windings to secondary windings, when toroid 180 serves as electromagnetic receiver 120, the signal carried by the current induced in the primary windings is increased in the secondary windings. Similarly, when toroid 180 serves as electromagnetic transmitter 124, the current in the primary windings is increased in the secondary windings.

Figure 4:
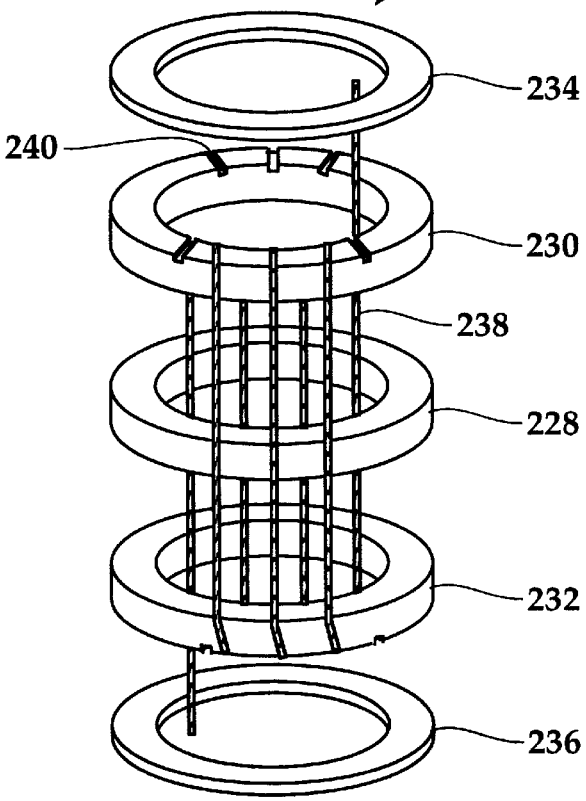
FIG. 4 is an exploded view of one embodiment of a toroid assembly for use as a receiver for a sonde of a subsea template electromagnetic telemetry system of the present invention.

Referring now to FIG. 4, an exploded view of a toroid assembly 226 is depicted. Toroid assembly 226 may be designed to serve, for example, as electromagnetic receiver 120 of FIG. 2. Toroid assembly 226 includes a magnetically permeable core 228, an upper winding cap 230, a lower winding cap 232, an upper protective plate 234 and a lower protective plate 236. Winding caps 230, 232 and protective plates 234, 236 are formed from a dielectric material such as fiberglass or phenolic. Windings 238 are wrapped around core 228 and winding caps 230, 232 by inserting windings 238 into a plurality of slots 240 which, along with the dielectric material, prevent electrical shorts between the turns of winding 238. For illustrative purposes, only one set of winding, windings 238, have been depicted. It will be apparent to those skilled in the art that, in operation, a primary and a secondary set of windings will be utilized by toroid assembly 226.

Figure 5:
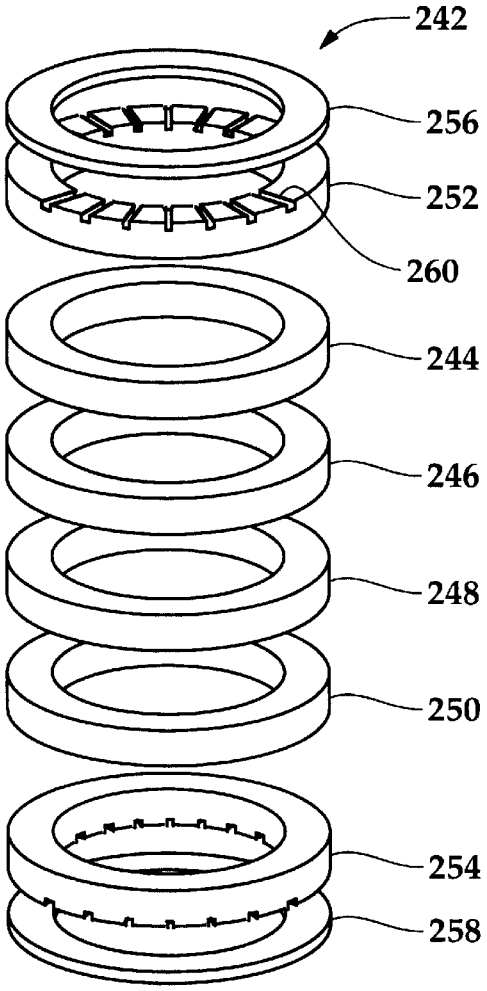
FIG. 5 is an exploded view of one embodiment of a toroid assembly for use as a transmitter for a sonde of a subsea template electromagnetic telemetry system of the present invention.

FIG. 5 depicts an exploded view of toroid assembly 242 which may serve, for example, as electromagnetic transmitter 124 of FIG. 2. Toroid assembly 242 includes four magnetically permeable cores 244, 246, 248 and 250 between an upper winding cap 252 and a lower winding cap 254. An upper protective plate 256 and a lower protective plate 258 are disposed respectively above and below upper winding cap 252 and lower winding cap 254. In operation, primary and secondary windings (not pictured) are wrapped around cores 244, 246, 248 and 250 as well as upper winding cap 252 and lower winding cap 254 through a plurality of slots 260.

As should be apparent from FIGS. 4 and 5, the number of magnetically permeable cores such as core 228 and cores 244, 246, 248 and 250 may be varied, dependent upon the required length for the toroid as well as whether the toroid serves as a receiver, such as toroid assembly 226, or a transmitter, such as toroid assembly 242. In addition, as will be known by those skilled in the art, the number of cores will be dependent upon the diameter of the cores as well as the desired voltage, current and frequency carried by the primary windings and the secondary windings, such as windings 238.

Figure 6:
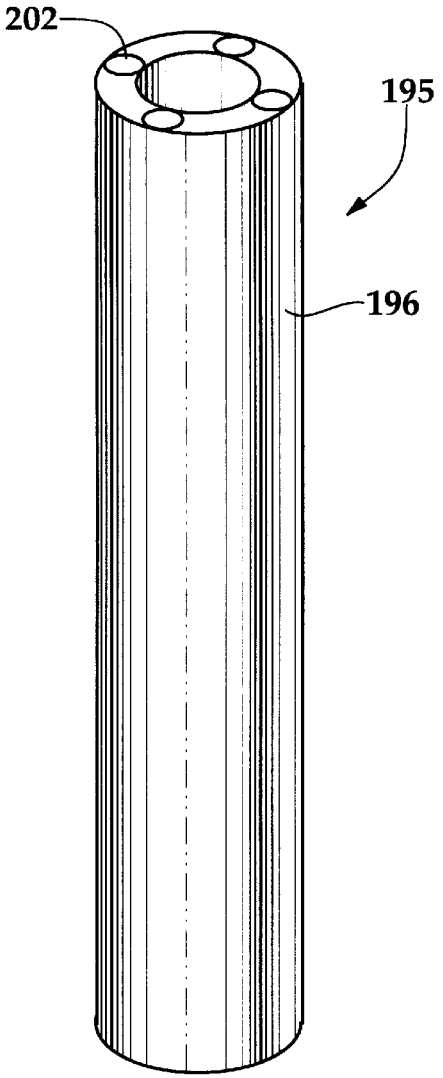
FIG. 6 is a perspective view of an annular carrier of an electronics package for a sonde of a subsea template electromagnetic telemetry system of the present invention.
Figure 7:
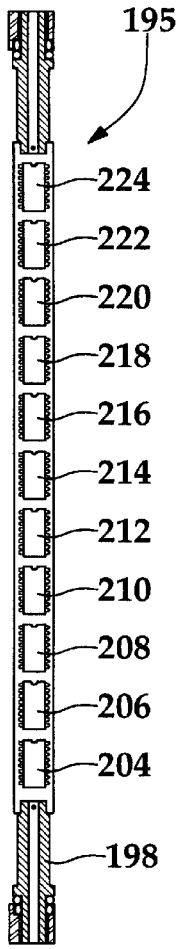
FIG. 7 is a perspective view of an electronics member having a plurality of electronic devices thereon for sonde of a subsea template electromagnetic telemetry system of the present invention.
Figure 8:
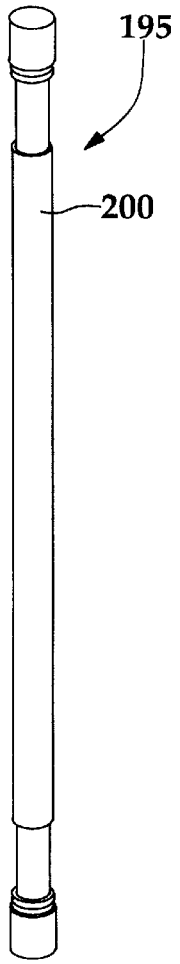
FIG. 8 is a perspective view of a battery pack for a sonde of a subsea template electromagnetic telemetry system of FIG. 9 is a block diagram of a signal processing method used by a sonde of a subsea template electromagnetic telemetry system of the present invention.

Turning next to FIGS. 6, 7 and 8 collectively, therein are depicted the components of an electronics package 195 of the present invention. Electronics package 195 may serve as the electronics package used in the sondes described above. Electronics package 195 includes an annular carrier 196, an electronics member 198 and one or more battery packs 200. Annular carrier 196 is disposed between outer housing 83 and mandrel 85. Annular carrier 196 includes a plurality of axial openings 202 for receiving either electronics member 198 or battery packs 200.

Even though FIG. 8 depicts four axial openings 202, it should be understood by one skilled in the art that the number of axial openings in annular carrier 196 may be varied. Specifically, the number of axial openings 202 will be dependent upon the number of battery packs 200 that are required.

Electronics member 198 is insertable into an axial opening 202 of annular carrier 196. Electronics member 198 receives a command signal from first end 188 of windings 184 when toroid 180 serves as, for example, electromagnetic receiver 120 of FIG. 2. Electronics member 198 includes a plurality of electronic devices such as limiter 204, preamplifier 206, notch filter 208, bandpass filters 210, phase lock loop 212, clock 214, shift registers 216, comparators 218, parity check 220, storage device 222, and amplifier 224. The operation of these electronic devices will be more full discussed with reference to FIGS. 9 and 10.

Battery packs 200 are insertable into axial openings 202 of axial carrier 196. Battery packs 200, which includes batteries such as nickel cadmium batteries or lithium batteries, are configured to provide the proper operating voltage and current to the electronic devices of electronics member 198 and to toroid 180.

Figure 9:
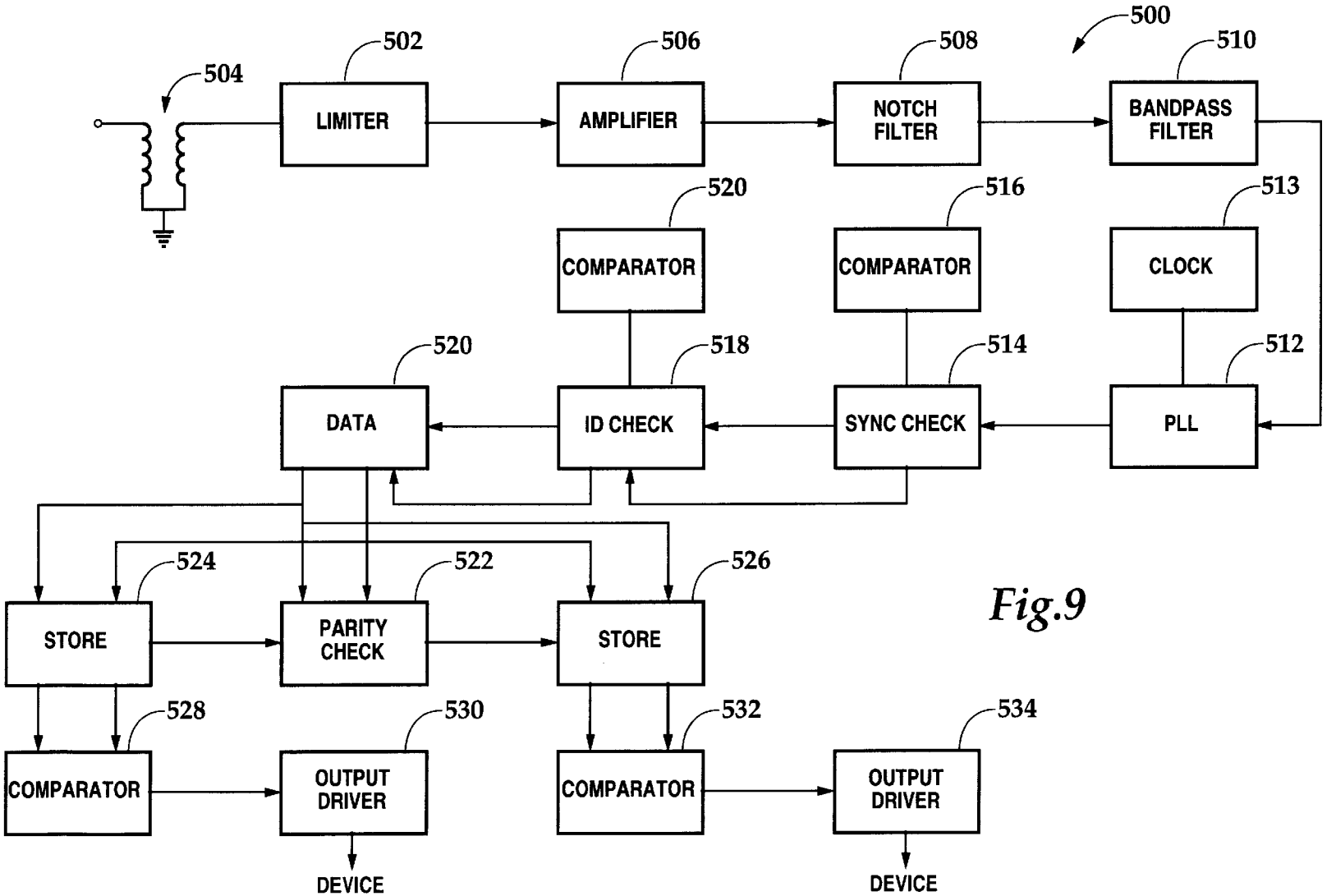

Turning now to FIG. 9 and with reference to FIG. 1, one embodiment of the method for processing the command signal is described. The method 500 utilizes a plurality of electronic devices such as those described with reference to FIG. 7. Method 500 provides for digital processing of the command signal generated by surface installation 58 and transmitted via electromagnetic wave fronts 65. Limiter 502 receives the command signal from electromagnetic receiver 504. Limiter 502 may include a pair of diodes for attenuating the noise in the command signal to a predetermined range, such as between about 0.3 and 0.8 volts. The command signal is then passed to amplifier 508 which may amplify the command signal to a predetermined voltage suitable for circuit logic, such as 5 volts. The command signal is then passed through a notch filter 508 to shunt noise at a predetermined frequency, such as 60 hertz. The command signal then enters a bandpass filter 510 to attenuate high noise and low noise and to recreate the original waveform having the original frequency, for example, two hertz.

The command signal is then fed through a phase lock loop 512 that is controlled by a precision clock 513 to assure that the command signal which passes through bandpass filter 510 has the proper frequency and is not simply noise. As the command signal will include a certain amount of carrier frequency first, phase lock loop 512 will verify that the received signal is, in fact, a command signal. The command signal then enters a series of shift registers that perform a variety of error checking features.

Sync check 514 reads, for example, the first six bits of the information carried in the command signal. These first six bits are compared with the six bits stored in comparator 516 to determine whether the command signal is carrying the type of information intended for a sonde, such as sondes 46, 48, 50, 53. For example, the first 6 bits in the preamble of the command signal must carry the code stored in comparator 516 in order for the command signal to pass through sync check 514. Each of the sondes of the present invention, such as sonde 46, 48, 50, 53 may use the same code in comparator 516.

If the first six bits in the preamble correspond with that in comparator 516, the command signal passes to an identification check 518. Identification check 518 determines 14, whether the command signal is uniquely associated with a specific downhole device controlled by that sonde. For example, the comparator 520 of sonde 48 will require a specific binary code while comparator 520 of sonde 50 will require a different binary code. Specifically, if the command signal is uniquely associated with bottom hole choke 62, the command signal will include a binary code that will correspond with the binary code stored in comparator 520 of sonde 48.

After passing through identification check 515, the command signal is shifted into a data register 520 which is in communication with a parity check 522 to analyze the information carried in the command signal for errors and to assure that noise has not infiltrated and abrogated the data stream by checking the parity of the data stream. If no errors are detected, the command signal is shifted into storage registers 524, 526. For example, once the command signal has been shifted into storage register 524, a binary code carried in the command signal is compared with that stored in comparator 528. If the binary code of the command signal matches that in comparator 528, the command signal is passed onto output driver 530. Output driver 530 generates a driver signal that is passed to the proper downhole device such that the operational state of the downhole device is changed. For example, sonde 50 may generate a driver signal to change the operational state of sliding sleeve 82 from open to close.

Similarly, the binary code in the command signal stored in storage register 526 is compared with that in comparator 532. If the binary codes match, comparator 532 forwards the command signal to output driver 534. Output driver 534 generates a driver signal to operate another downhole device. For example, sonde 50 may generate a driver signal to change the operational state of sliding sleeve 80 from closed to open to allow formation fluids from the top of formation 14 to flow into well 26.

Once the operational state of the downhole device has been changed according to the command signal, a verification signal is generated and returned to sonde 50. The verification signal is processed by sonde 50 and passed on to electromagnetic transmitter 84 of sonde 50. Electromagnetic transmitter 84 transforms the verification signal into electromagnetic wave fronts 86, which are radiated into the earth to be picked up by subsea template 47. As explained above, the verification signal is then forwarded to surface installation 58 via electrical wire 51.

Even though FIG. 9 has described sync check 514, identifier check 518, data register 520 and storage registers 524, 526 as shift registers, it should be apparent to those skilled in the art that alternate electronic devices may be used for error checking and storage including, but not limited to, random access memory, read only memory, erasable programmable read only memory and a microprocessor.

Figure 10A:
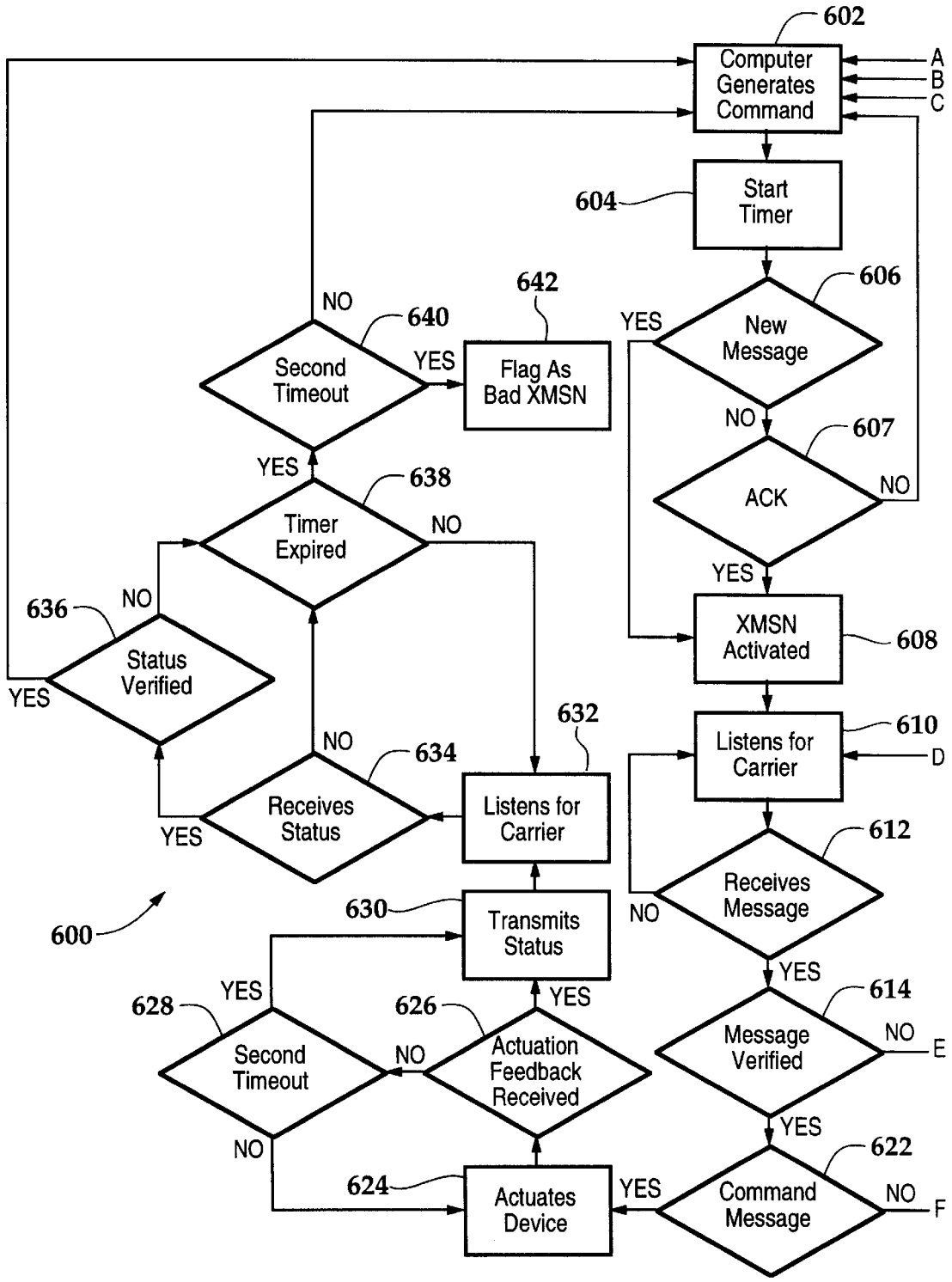
FIGS. 10A–B are flow diagrams of a method for operating a subsea template electromagnetic telemetry system of the present invention.
Figure 10B:
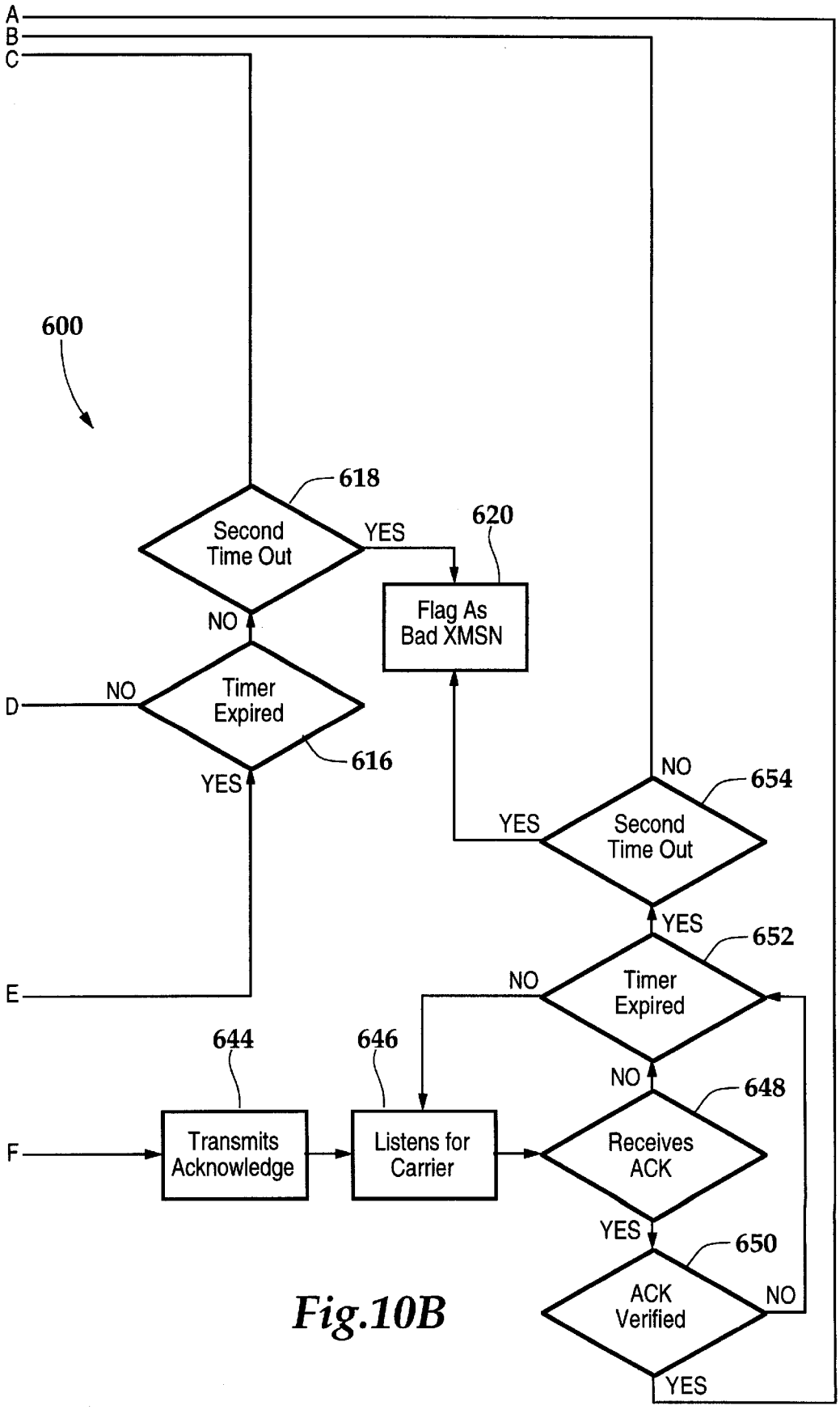

In FIGS. 10A–B, a method for operating a subsea template electromagnetic telemetry system of the present invention is shown in a block diagram generally designated 600. The method begins with the generation of a command signal 602 by surface installation 58. When the command signal 602 is generated, a timer 604 is set. If the command signal 602 is a new message 606, surface installation 58 initiates the transmission of command signal 602 in step 608. if command signal 602 is not a new message, it must be acknowledged in step 607 prior to being transmitted in step 608.

Transmission 608 involves sending the command signal 602 to subsea template 47 via electrical wire 51 and generating electromagnetic wave fronts 65. The sondes listen for the command signal 602 in step 610. When a command message 602 is received by a sonde in step 612, the command signal 602 is verified in step 614 as described above with reference to FIG. 9. If the sonde is unable to verify the command signal 602, and the timer has not expired in step 616, the sonde will continue to listen for the command signal in step 610. If the timer has expired in step 616, and a second time out occurs in step 618, the command signal is flagged as a bad transmission in step 620.

If the command signal 602 is requesting a change in the operational state of a downhole device, a driver signal is generated in step 622 such that the operational state of the downhole device is changed in step 624. Once the operational state of the downhole device has been chanced, the sonde receives a verification signal from the downhole device in step 626. If the verification signal is not received, the sonde will again attempt to change the operational state of the downhole device in step 624. If a verification signal is not received after the second attempt to change the operational state of the downhole device, in step 628, a message is generated indicating that there has been a failure to change the operational state of the downhole device.

The status of the downhole device, whether operationally changed or not, is then transmitted by the sondre in step 630. The surface installation listens for the carrier in step 632 and receives the status signal in step 634, which is verified by the surface installation in step 636. If the surface installation does not receive the status message in step 634, the surface installation continues to listen for a carrier in step 632. If the timer has expired in step 638, and a second time out has occurred in step 640, the transmission is flagged as a bad transmission in step 642. Also, if the surface installation is unable to verify the status of the downhole device in step 636, the surface installation will continue to listen for a carrier in step 632. If the timers in steps 638, 640 have expired, however, the transmission will be flagged as a bad transmission in step 642.

In addition, the method of the present invention includes a check back before operate loop which may be used prior to the actuation of a downhole device. In this case, command message 602 will not change the operational slate of a downhole device, in step 622, rather the sonde will simply acknowledge the command signal 602 in step 644. The surface installation will listen for a carrier in step 646, receive the acknowledgment in step 648 for verification in step 650. If the surface installation does not receive the acknowledgment in step 648, the surface installation will continue to listen for a carrier in step 646. If the timers have expired in steps 652, 654, the transmission will be flagged as a bad transmission in step 620. Additionally, if the surface installation is unable to verify the acknowledgment in step 650, the surface installation will continue to listen for a carrier in step 646. If the timers in step 652 and step 654 have timed out, however, the transmission will be flagged as a bad transmission in step 620.

While this invention has been described with a reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. An electromagnetic downlink and pickup apparatus for transmitting and receiving electromagnetic signals comprising:

a subsea conductor;

a surface installation having a signal generator; and first and second conduits electrically connecting the subsea conductor and the surface installation, the first and second conduits forming a pair terminals on the subsea conductor between which a voltage potential is established to provide a path for current flow therebetween such that when the signal generator injects a current carrying information into the subsea conductor, electromagnetic waves carrying the information are generated.

2. The apparatus as recited in claim 1 wherein the subsea conductor is a subsea template.

3. A The apparatus as recited in claim 1 wherein the surface installation further comprises a signal receiver for interpreting information carried in a current generated in the subsea conductor by electromagnetic waves.

4. The apparatus as recited in claim 1 wherein the first conduit further comprises an electrical wire.

5. The apparatus as recited in claim 1 wherein the first conduit further comprises a riser pipe.

6. The apparatus as recited in claim 5 wherein the riser pipe further comprises a platform leg.

7. The apparatus as recited in claim 5 wherein the riser pipe further comprises a conductor pipe of a well.

8. The apparatus as recited in claim 1 further comprising an electrical coupling extending outwardly from the subsea conductor through the sea floor to provide a connection between the first conduit and the subsea conductor.

9. The apparatus as recited in claim 8 wherein the electrical coupling further comprises a post.

10. The apparatus as recited in claim 8 wherein the electrical coupling further comprises a ring.

11. An electromagnetic downlink and pickup apparatus for transmitting and receiving electromagnetic signals comprising:

a subsea template;

a surface installation having a signal generator and a signal receiver; and first and second conduits electrically connecting the subsea template and the surface installation, the first and second conduits forming a pair terminals on the subsea template between which a voltage potential is established to provide a path for current flow therebetween such that when the signal generator injects a current carrying information into the subsea template, electromagnetic waves carrying the information are generated and such that when electromagnetic waves carrying information generate a current in the subsea conductor, the signal receiver interprets the information carried in the current.

12. The apparatus as recited in clans 11 wherein the first conduit further comprises an electrical wire.

13. The apparatus as recited in claim 11 wherein the first conduit further comprises a riser pipe.

14. The apparatus as recited in claim 13 wherein the riser pipe further comprises a platform leg.

15. The apparatus as recited in claim 13 wherein the riser pipe further comprises a conductor pipe of a well.

16. The apparatus as recited in claim 11 further comprising and electrical coupling extending outwardly from the subsea template through the sea floor to provide a connection between the first conduit and the subsea template.

17. The apparatus as recited in claim 16 wherein the electrical coupling further comprises a post.

18. The apparatus as recited in claim 16 wherein the electrical coupling further comprises a ring.

19. A downhole telemetry system for changing the operational state of a downhole device, the system comprising:

a subsea conductor;

a surface installation for transmitting a command signal;

first and second conduits electrically connecting the subsea conductor and the surface installation, the first and second conduits forming a pair terminals on the subsea conductor between which a voltage potential is established to provide a path for current flow therebetween, the subsea conductor electromagnetically transmitting the command signal;

an electromagnetic receiver disposed in a wellbore for receiving the command signal; and an electronics package electrically connected to the electromagnetic receiver and operably connected to the downhole device, the electronics package generating a driver signal in response to the command signal that prompts the downhole device to change operational states.

20. The system as recited in claim 19 wherein the electromagnetic receiver further comprises a magnetically permeable annular core, a plurality of primary electrical conductor windings wrapped axially around the annular core and a plurality of secondary electrical conductor windings wrapped axially around the annular core.

21. The system as recited in claim 19 further comprising an electromagnetic transmitter disposed in the wellbore for transmitting a verification signal.

22. The system as recited in claim 21 wherein the subsea conductor receives the verification signal.

23. The system as recited in claim 22 wherein the verification signal is transmitted to the surface installation from the subsea conductor via the first conduit.

24. The system as recited in claim 21 wherein the electromagnetic transmitter further comprises a magnetically permeable annular core, a plurality of primary electrical conductor windings wrapped axially around the annular core and a plurality of secondary electrical conductor windings wrapped axially around the annular core.

25. The system as recited in claim 19 wherein the command signal further comprises a command sIgnal uniquely associated with the downhole device.

26. The system as recited in claim 25 wherein the electronics package determines whether the command signal is uniquely associated with the downhole device.

27. The system as recited in claim 19 wherein the subsea conductor is a subsea template.

28. The system as recited in claim 19 wherein the first conduit further comprises an electrical wire.

29. The system as recited in claim 19 wherein the first conduit further comprises a riser pipe.

30. The system as recited in claim 29 wherein the riser pipe further comprises a platform leg.

31. The system as recited in claim 29 wherein the riser pipe further comprises a conductor pipe of a well.

32. The system as recited in claim 19 further comprising an electrical coupling extending outwardly from the subsea conductor through the sea floor to provide a connection between the first conduit and the subsea conductor.

33. A method of transmitting electromagnetic signals to a downhole device to prompt the downhole device to change operational states comprising the steps of:

transmitting an electrical command signal from a surface installation to a subsea conductor, the surface installation and the subsea conductor coupled together by a pair of conduits forming a pair of terminals on the subsea conductor between which a voltage potential is established;

generating an electromagntic command signal from the subsea conductor;

receiving the electromagnetic command signal on an electromagnetic receiver disposed in a wellbore;

generating a driver signal with an electronics package electrically connected to the electromagnetic receiver in response to the electromagnetic command signal; and receiving the driver signal at the downhole device, thereby prompting the downhole device to change operational states.

34. The method as recited in claim 33 further comprising the step of transmitting a verification signal from an electromagnetic transmitter disposed in the wellbore.

35. The method as recited in claim 34 further comprising the step of receiving the verification signal on the subsea conductor.

36. The method as recited in claim 35 further comprising the step of transmitting the verification signal from the subsea conductor to the surface installation.

37. The method as recited in claim 36 wherein the step of transmitting the verification signal from the subsea conductor to the surface installation further comprises transmitting the verification signal via an electrical conduit.

38. The method as recited in claim 33 wherein the command signal is uniquely associated with the downhole device.

39. The method as recited in claim 38 further comprising the step of determining whether the command signal is uniquely associated with the downhole device.

40. An electromagnetic downlink and pickup apparatus for transmitting and receiving electromagnetic signals comprising:

a subsea conductor;

a surface installation having a signal receiver; and first and second conduits electrically connecting the subsea conductor and the surface installation, the first and second conduits forming a pair terminals on the subsea conductor between which a voltage potential is established to provide a path for current flow therebetween such that when electromagnetic waves carrying information generate a current in the subsea conductor, the signal receiver interprets the information carried in the current.

41. The apparatus as recited in claim 40 wherein the subsea conductor is a subsea template.

42. The apparatus as recited in claim 40 wherein the surface installation further comprises a signal generator for injecting a current carrying information into the subsea conductor, thereby generating electromagnetic waves carrying the information.

43. The apparatus as recited in claim 40 wherein the first conduit further comprises an electrical wire.

44. The apparatus as recited in claim 40 wherein the first conduit further comprises a riser pipe.

45. The apparatus as recited in claim 44 wherein the riser pipe further comprises a platform leg.

46. The apparatus as recited in claim 44 wherein the riser pipe further comprises a conductor pipe of a well.

47. The apparatus as recited in claim 40 further comprising an electrical coupling extending outwardly from the subsea conductor through the sea floor to provide a connection between the first conduit and the subsea conductor.

48. The apparatus as recited in claim 47 wherein the electrical coupling further comprises a post.

49. The apparatus as recited in claim 47 wherein the electrical coupling further comprises a ring.

* * * * *